US007966948B1

(12) United States Patent
Galietti

(10) Patent No.: US 7,966,948 B1
(45) Date of Patent: Jun. 28, 2011

(54) PORTABLE FOLDING BAR

(76) Inventor: Thomas Michael Galietti, Huntington Beach, CA (US)

( * ) Notice: Subject to any disclaimer, the term of this patent is extended or adjusted under 35 U.S.C. 154(b) by 691 days.

(21) Appl. No.: 12/008,786

(22) Filed: Jan. 14, 2008

(51) Int. Cl.
*A47B 23/00* (2006.01)

(52) U.S. Cl. ..... 108/42; 108/134

(58) Field of Classification Search ..... 312/140.1, 312/140.3, 244, 313–315, 245, 317.3; 108/42, 108/134, 135, 152, 38, 14, 33–35, 115, 108; 248/240, 240.3, 235; 5/655, 136, 133, 947; 182/206, 84, 97
See application file for complete search history.

(56) References Cited

U.S. PATENT DOCUMENTS

| | | | | | |
|---|---|---|---|---|---|
| 624,115 | A | * | 5/1899 | Steele | 108/134 |
| 1,143,489 | A | | 6/1915 | Bebchtold | |
| 1,582,380 | A | * | 4/1926 | Carpenter et al. | 297/163 |
| 1,800,075 | A | | 4/1931 | Imrie | |
| 2,515,876 | A | * | 7/1950 | Kauffman | 312/241 |
| 2,801,893 | A | | 8/1957 | Macaisese | |
| 2,843,436 | A | * | 7/1958 | Franks | 108/134 |
| 4,037,896 | A | | 7/1977 | Kennedy, Jr. et al. | |
| 4,147,395 | A | | 4/1979 | Gale | |
| 4,736,918 | A | | 4/1988 | Bessinger | |
| 4,889,057 | A | * | 12/1989 | Chartrand | 108/42 |
| 4,966,258 | A | * | 10/1990 | Hawley | 190/4 |
| 4,998,484 | A | * | 3/1991 | Groetzinger | 108/42 |
| 5,044,285 | A | * | 9/1991 | Wolfe, III | 108/152 |
| 5,184,886 | A | | 2/1993 | Handley et al. | |
| D342,392 | S | | 12/1993 | Mujica | |
| 5,382,087 | A | | 1/1995 | Pouch | |
| 5,915,602 | A | | 6/1999 | Nelson | |
| 6,039,416 | A | * | 3/2000 | Lambert | 312/245 |
| 6,161,486 | A | * | 12/2000 | Boots | 108/48 |
| D448,391 | S | | 9/2001 | Stauffer et al. | |
| 6,343,834 | B1 | * | 2/2002 | Wurmlinger | 297/14 |
| 6,729,685 | B1 | * | 5/2004 | Ebalobor | 297/14 |
| 6,752,091 | B2 | * | 6/2004 | Glover et al. | 108/168 |
| 6,918,640 | B2 | | 7/2005 | DeMars | |
| 6,957,876 | B1 | | 10/2005 | DeMars | |
| 7,101,000 | B2 | | 9/2006 | DeMars | |
| 7,464,652 | B2 | * | 12/2008 | Hauck | 108/48 |
| 2005/0035693 | A1 | | 2/2005 | Reamer | |
| 2006/0017354 | A1 | | 1/2006 | DeMars | |
| 2006/0038467 | A1 | | 2/2006 | DeMars | |
| 2006/0163975 | A1 | | 7/2006 | DeMars | |

* cited by examiner

*Primary Examiner* — Janet M Wilkens
(74) *Attorney, Agent, or Firm* — Patent Law Agency, LLC; Peter Ganjian

(57) ABSTRACT

A portable folding bar includes a table top piece forming a table counter top, and a frame coupled with the table top piece for coupling the portable folding bar with a structure, and includes an ergonomic handle coupled with the frame for transporting the portable folding bar.

10 Claims, 24 Drawing Sheets

PORTABLE FOLDING BAR

BACKGROUND OF THE INVENTION (1) Field of the Invention

This invention is related to a bar table and, more particularly to a portable folding bar table.

(2) Description of Related Art

Prior art conventional bar tables are well known and have been in use for a number of years. Reference is made to the following few exemplary U.S. Patent Publications, including U.S. Pat. Nos. 7,101,000; 6,918,640; 6,957,876; 5,915,602; 5,382,087; 5,184,886; 4,147,395; 4,736,918; 4,037,896; 2,801,893; 1,800,075; 1,143,489; D448,391; and D342,392; and U.S. Patent Application Publications 20060038467; 20060017354; 20060163975; and 20050035693. Regrettably, most prior art conventional bar tables are not truly portable and suffer from obvious disadvantages in that they cannot be quickly and easily assembled and disassembled, and are bulky.

Accordingly, in light of the current state of the art and the drawbacks to current bar tables mentioned above, a need exists for a portable bar table that would be truly portable and that would be easily assembled for use and disassemble for transport.

BRIEF SUMMARY OF THE INVENTION

One aspect of the present invention provides a portable folding bar, comprising a table top piece forming a table counter top; a frame coupled with the table top piece for coupling with a structure; and a handle coupled with the frame for transporting the portable folding bar.

An optional aspect of the present invention provides a portable table folding bar, wherein the table top piece includes:

- a substantially flat top surface that forms the table counter top;
- an edge around at least one side with sufficient depth for storage of the frame when the frame is folded in closed position;
- the edge including a notch having a height less than the height of the edge for storage of the handle when the frame is folded in closed position;
- a first set of apertures on lateral sides of the table top piece and oriented along an axial width of the table top piece for coupling of the frame to the table top piece 202 by a mounting cap;
- a substantially flat bottom surface that includes one or more frame guides juxtaposed in parallel and axially oriented perpendicular along an axial length of the portable folding bar, and the one or more frame guides support the frame to prevent lateral movement of the frame when folded in closed position.

Another optional aspect of the present invention provides a portable table folding bar, wherein the mounting cap is a single piece, integral unit, and includes:

- a first section having a first and second mounting cap securing apertures that are aligned with a respective second set of apertures on lateral sides of the table top piece and oriented along the axial width thereof;
- a third set of fasteners that fasten the mounting cap onto the lateral sides of the table top piece via the first and second mounting cap securing apertures and the aligned respective second set of apertures;
- a second section, perpendicular to the first section, that is comprised of a hollow tube with a first cross-sectional diameter that is inserted into a pivoting tube that is hollow with a second cross-sectional diameter larger than the first cross-sectional diameter, enabling the frame to pivot to one of a close and open positions while the second section of the mounting cap is secure within the hollow pivoting tube.

Yet another optional aspect of the present invention provides a portable table folding bar, wherein the one or more frame guides are comprised of:

- a first piece and a second piece that are juxtaposed at a distance and in parallel, and are axially oriented perpendicular along an axial length of the portable folding bar, and parallel along the axial width thereof;
- the first piece and the second piece of the one or more frame guides have an axial length that is shorter than the axial width of the table top piece; and
- the one or more frame guides have sufficient distance from one another to enable the frame struts to be stored in between the first and the second pieces of the one or more frame guides.

A further optional aspect of the present invention provides a portable table folding bar, wherein the bottom surface of the table top piece further includes:

- frame interlock mechanism that is a single piece integral unit that is comprised of a first and second cantilevers that are coupled with a base to form a substantially "U" shaped structure, with a free ends of the first and second cantilevers having rounded edges facing an interior of the frame interlock mechanism to facilitate insertion and removal of the frame therein between the first and second cantilevers.

Still a further optional aspect of the present invention provides a portable table folding bar, wherein the frame is comprised of

- a first elongated member and a second elongated member that are spaced apart and juxtapose laterally, forming an axial length of the frame;
- one or more a third members substantially transversally oriented at an angle θ along the axial length of the frame;
- the one or more third members couple the first elongated member with the second elongated member to form the frame;
- one or more collapsible support arms comprised of a first arm section and a second arm section;
- the first arm section including a first end coupled with the bottom surface of the table top piece by a first hinge mechanism, and includes a first pivot end;
- the second arm section including a second end coupled with the first elongated member of the frame by a second hinge mechanism, and includes a second pivot end;
- the first pivot end is coupled with the second pivot end by a third hinge mechanism forming an elbow, and locked in an extended open position by a lock pin when the portable folding bar is in the open position, orienting the table top piece and the frame perpendicular to one another, whereby the table top piece is horizontal to ground and the frame is vertical to ground.

Another optional aspect of the present invention provides a portable table folding bar, wherein the frame further includes mounting holes that can be used to mount the frame onto the structure.

Yet another optional aspect of the present invention provides a portable table folding bar, wherein:

- the handle includes:
- an ergonomic hand grip;
- two support posts;
- the hand grip is integral with the two support posts;

the two support posts are coupled with the first elongated member of the frame; and the frame includes two apertures that is aligned with two post apertures and are couple by fasteners.

These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character (s) present corresponding part(s) throughout.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

Figure 1A:
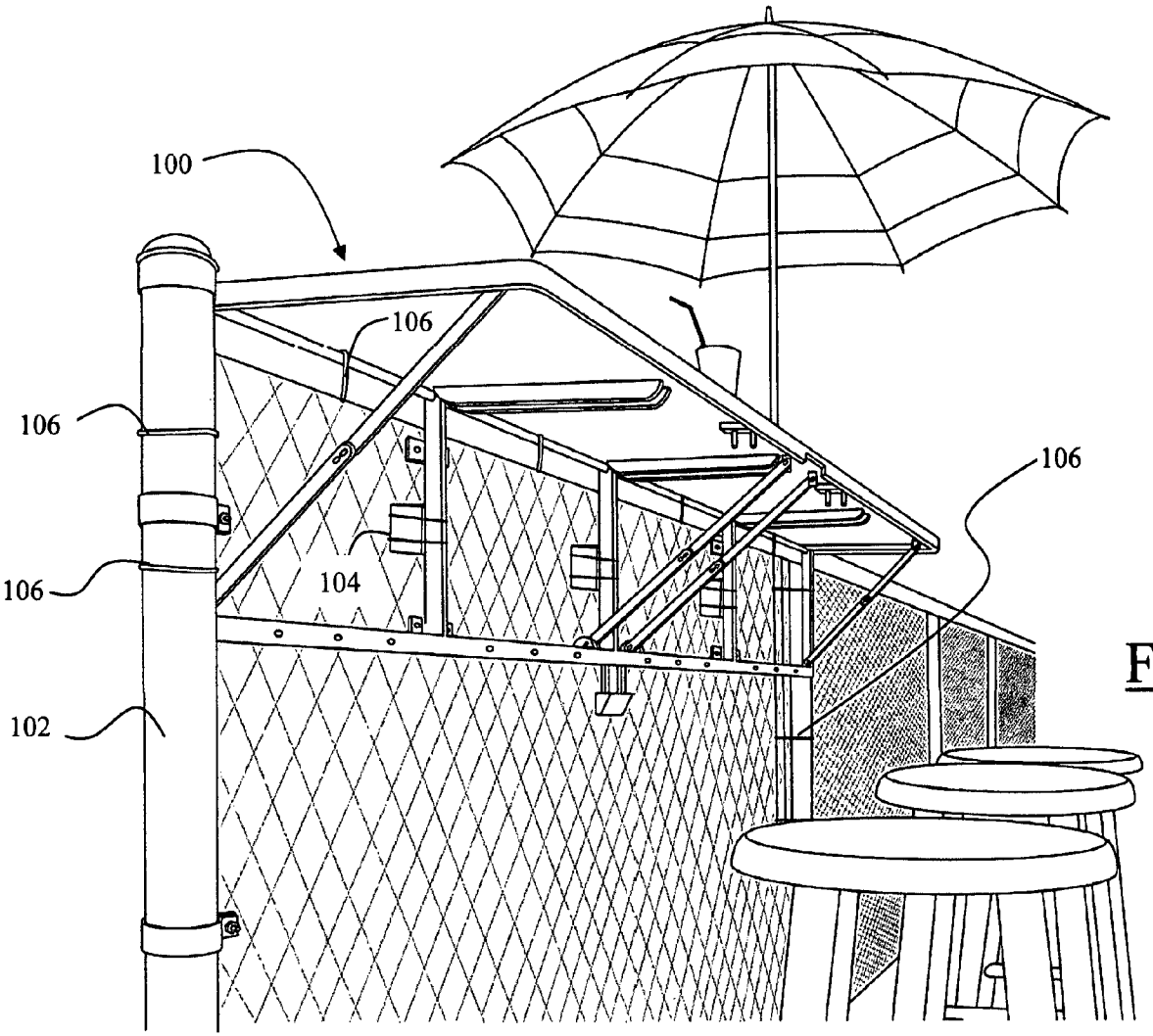
FIG. 1A is an exemplary perspective illustration of a portable folding bar coupled with a cyclone fence in accordance with the present invention.
Figure 1B:
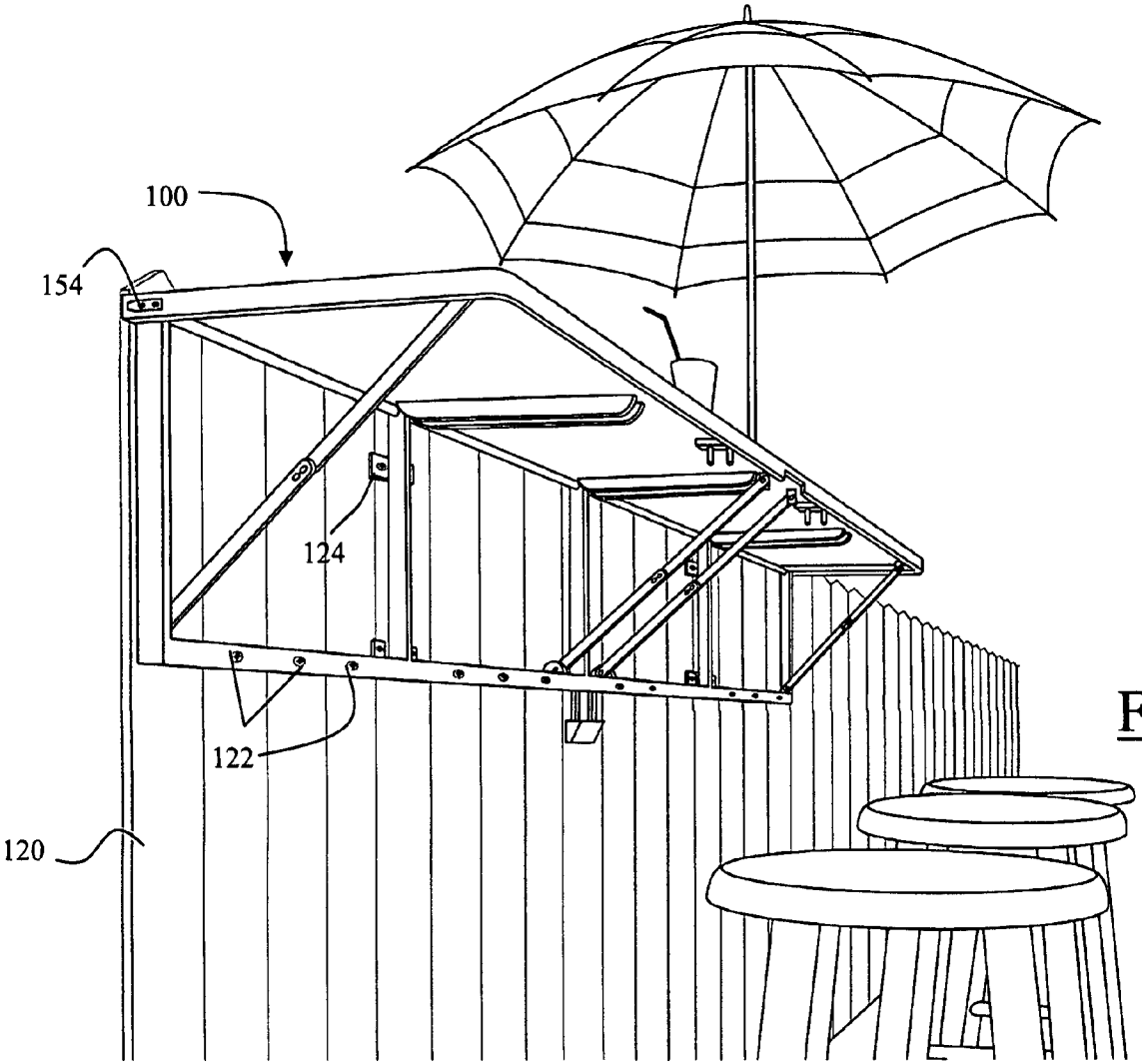
FIG. 1B is an exemplary perspective illustration of the portable folding bar of FIG. 1A coupled with a wooden fence in accordance with the present invention.
Figure 1C:
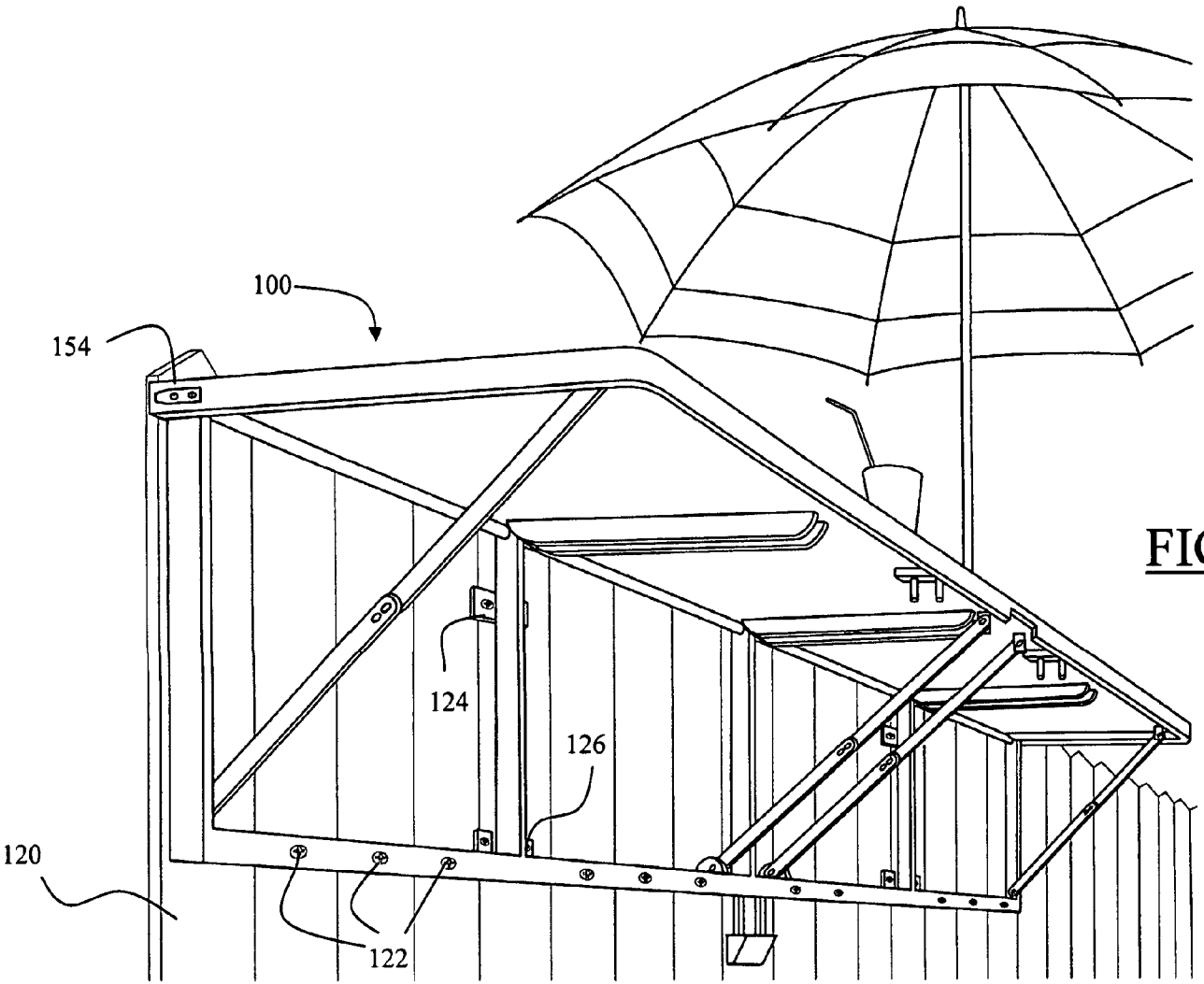
FIG. 1C is an exemplary perspective close-up illustration of the portable folding bar of FIG. 1B in accordance with the present invention.

FIGS. 1A to 1C are a few exemplary illustrations of structures to which a portable folding table 100 of the present invention may be detachably coupled. FIG. 1A is an exemplary perspective illustration of the portable folding bar 100 coupled with a cyclone fence 102 in accordance with the present invention. As illustrated, the portable folding bar 100 is easily and quickly detachably coupled to a cyclone fence 102 using a plurality of fasteners, non-limiting examples of which may include zip-ties or the like. One or more spacers 104 may optionally be used in order to align the vertical axis of the portable folding bar 100 perpendicular with the ground, making the table top piece horizontally parallel with the ground.

Figure 2A:
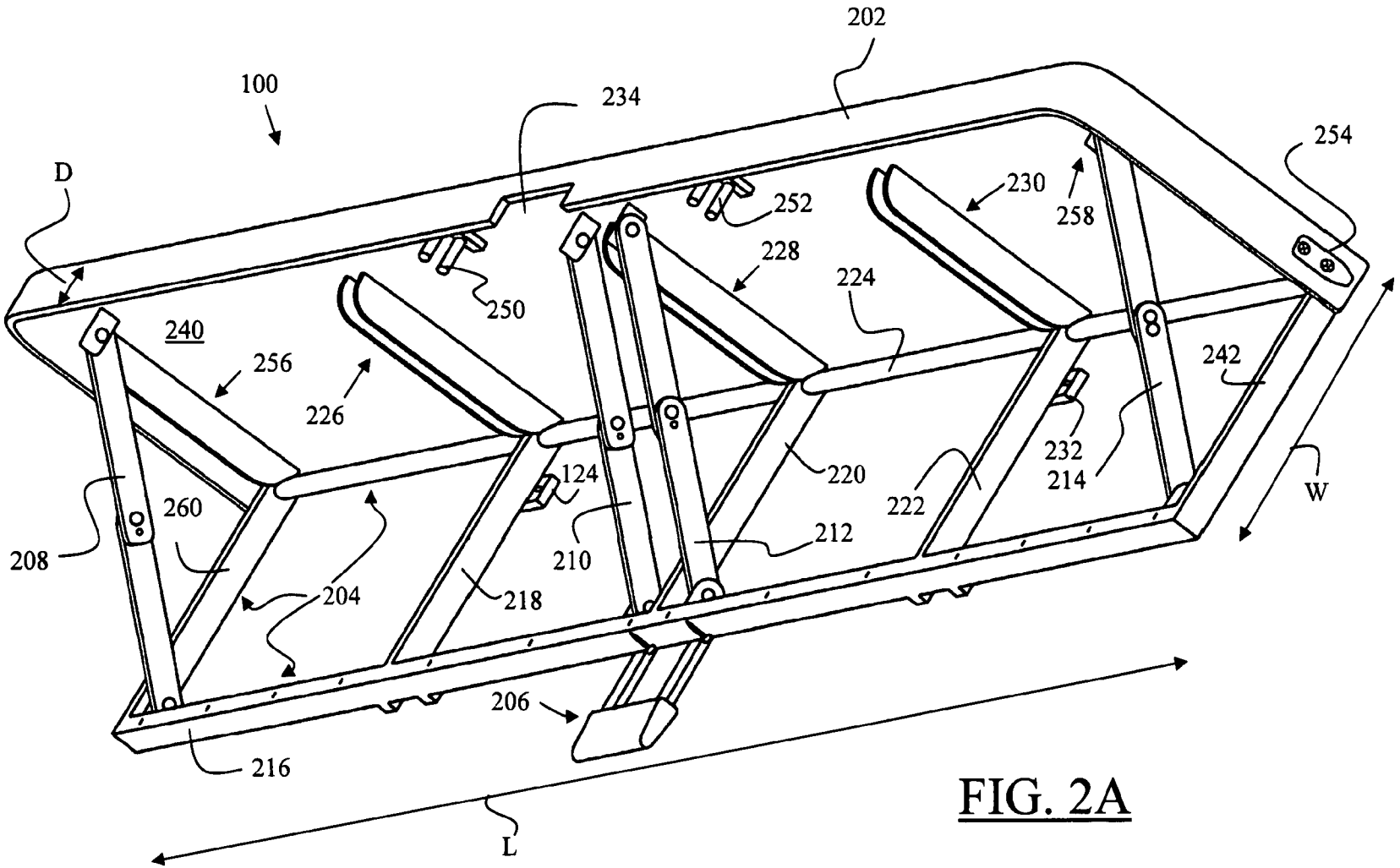
FIG. 2A is an exemplary perspective illustration of the portable folding bar of FIGS. 1A to 1C in an open position, detailing the various aspects thereof in accordance with the present invention.
Figure 2B:
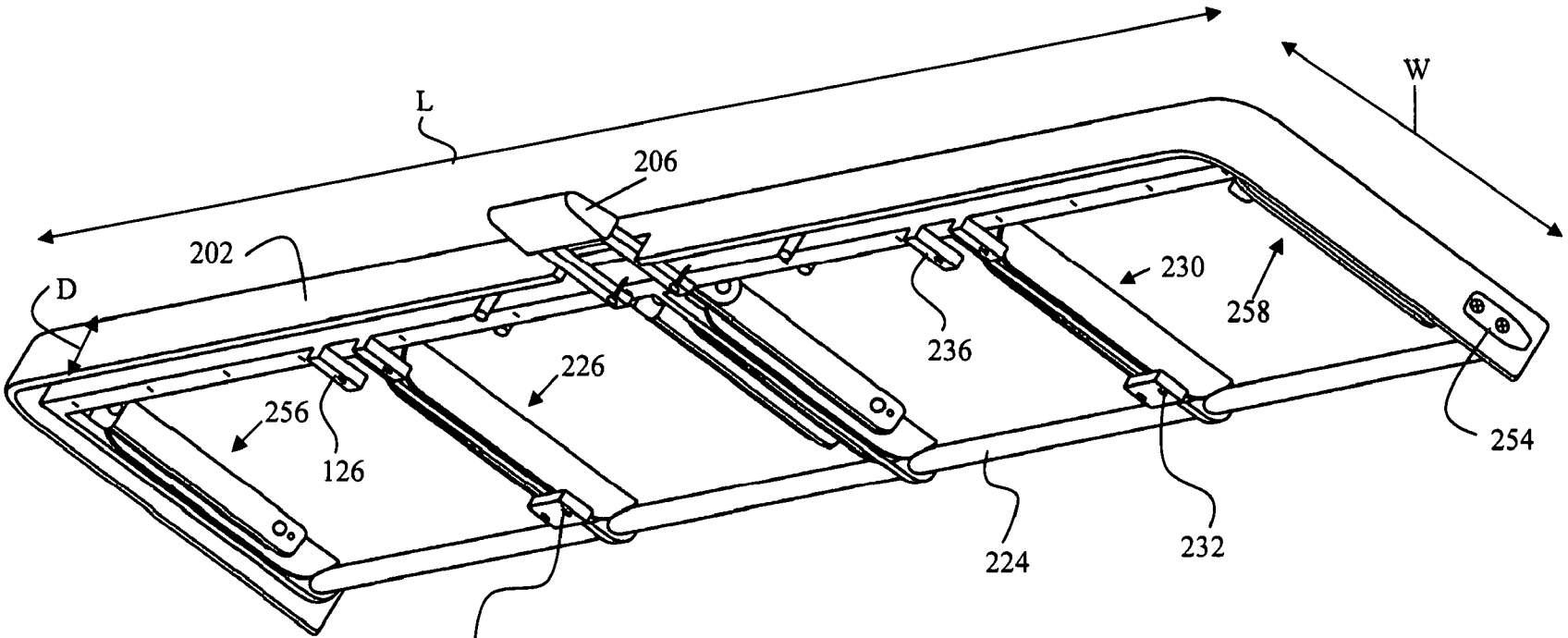
FIG. 2B is an exemplary perspective illustration of the portable folding bar of FIGS. 1A to 1C in a folded position, detailing the various aspects thereof in accordance with the present invention.
Figure 2C:
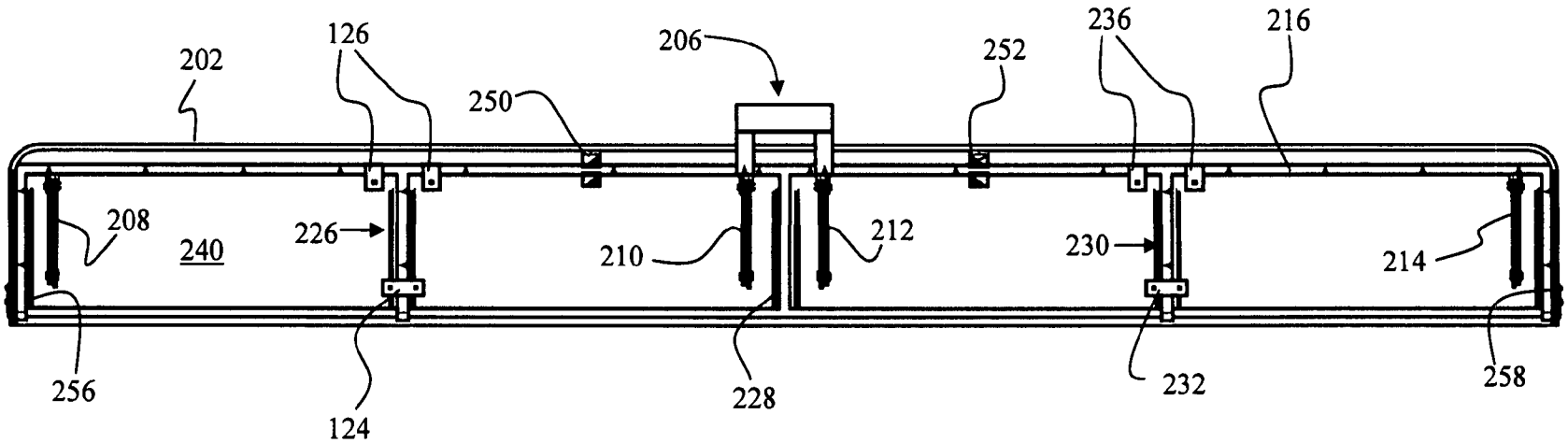
FIG. 2C is an exemplary plan view illustration of the bottom side of the portable folding bar of FIGS. 1A to 1C in a folded position, detailing the various aspects thereof in accordance with the present invention.
Figure 2D:
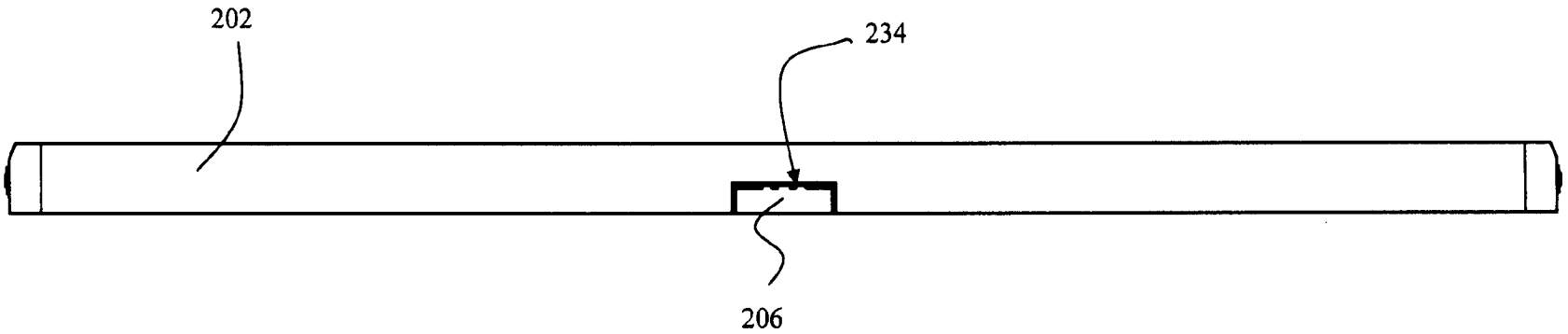
FIG. 2D is an exemplary plan-view illustration of the front of the portable folding bar of FIGS. 1A to 1C in a folded position, detailing the various aspects thereof in accordance with the present invention.
Figure 2E:
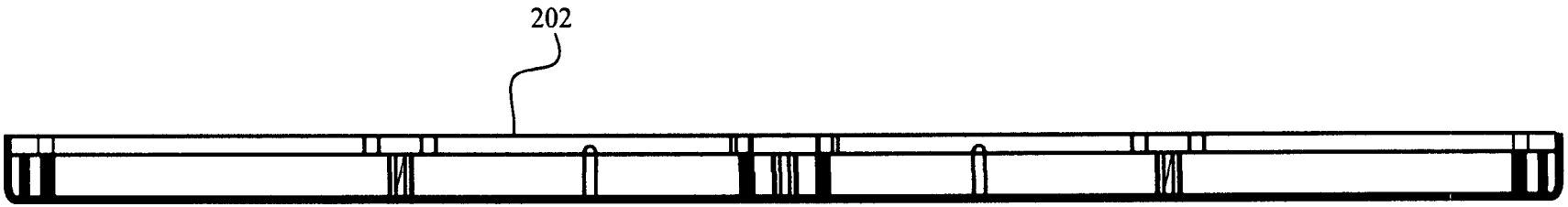
FIG. 2E is an exemplary plan-view illustration of the back of the portable folding bar of FIGS. 1A to 1C in a folded position, detailing the various aspects thereof in accordance with the present invention.
Figure 2F:
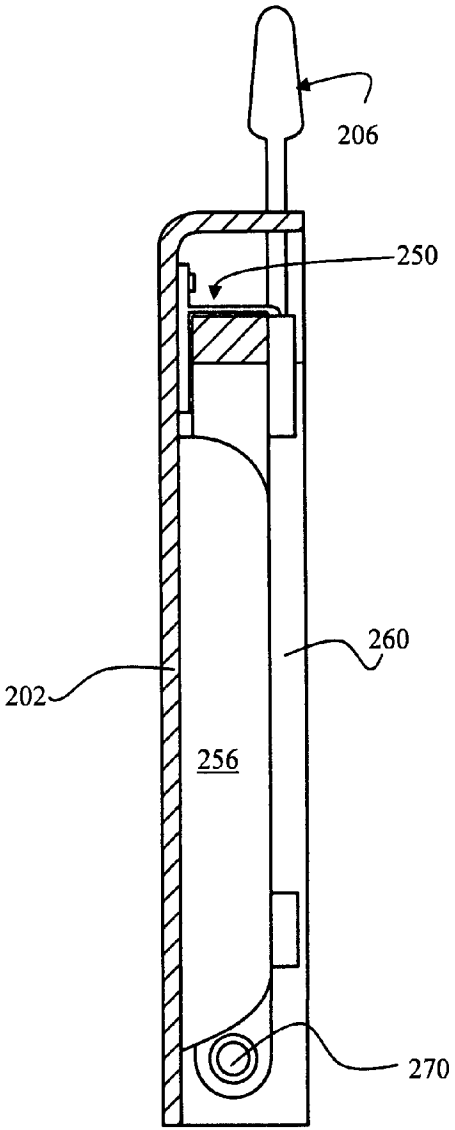
FIG. 2F is an exemplary side cross-sectional view illustration of the portable folding bar of FIGS. 1A to 1C in a folded position, detailing the various aspects thereof in accordance with the present invention.

FIG. 1B is an exemplary perspective illustration of the portable folding bar 100 of FIG. 1A, but coupled with a wooden fence 120 in accordance with the present invention, and FIG. 1C is an exemplary perspective close-up illustration of the portable folding bar 100 of FIG. 1B. As illustrated, the portable folding bar 100 may be detachably coupled to a wooden fence 120 using a plurality of fasteners inserted through various connection apertures 122 that are aligned along its first elongated member 216 (FIG. 2A). Additional fasteners may optionally be used through the various mounting tabs 124, 126, and 232, 236 (FIG. 2B) on the frame 204 (FIG. 3) of the portable folding bar. Non-limiting examples of fasteners that may be used for detachably coupling the portable folding bar 100 to a structure may include screws or the like. Accordingly, the portable folding bar 100 of the present invention may be easily and quickly detachably coupled with most vertically oriented structures such as walls, fences, trees, or the like that can bear the weight of the portable folding table 100.

FIGS. 2A to 2F are exemplary illustrations of the various views of the portable folding bar 100 of FIGS. 1A to 1C, detailing the various aspects thereof in accordance with the present invention. As illustrated in FIGS. 2A to 2F, the present invention provides a portable folding bar 100 that easily assembles and disassembles for use and transport, and is comprised of a table top piece 202 forming a table counter top, a frame 204 coupled with the table top piece 202 for detachably coupling the portable folding bar 100 with a structure, and a handle 206 coupled with the frame 204 for transporting the portable folding bar 100.

Figure 3:
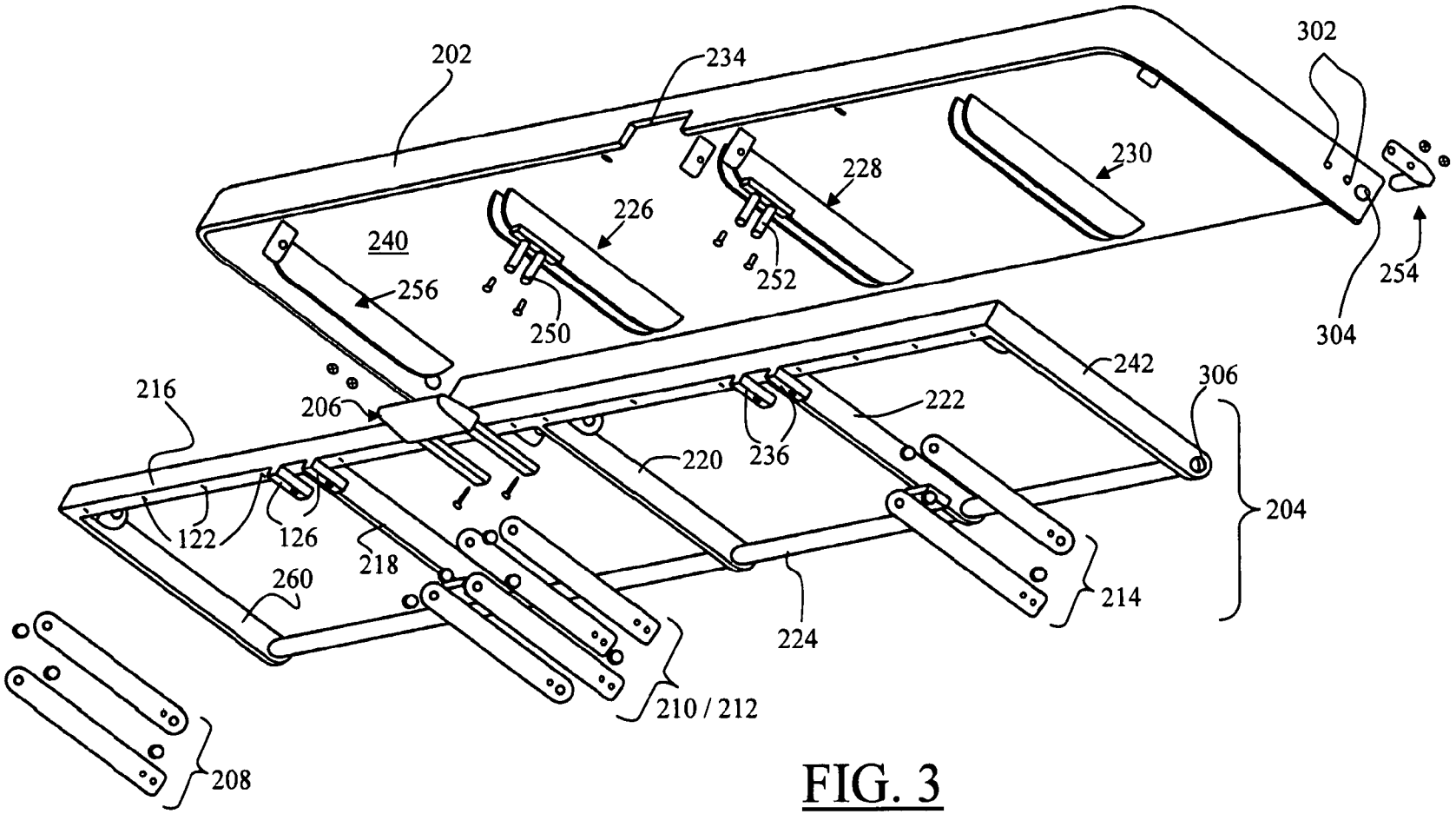
FIG. 3 is an exemplary perspective illustration of the disassembled portable folding bar of FIGS. 1A to 1C, detailing the various aspects thereof in accordance with the present invention.
Figure 4A:
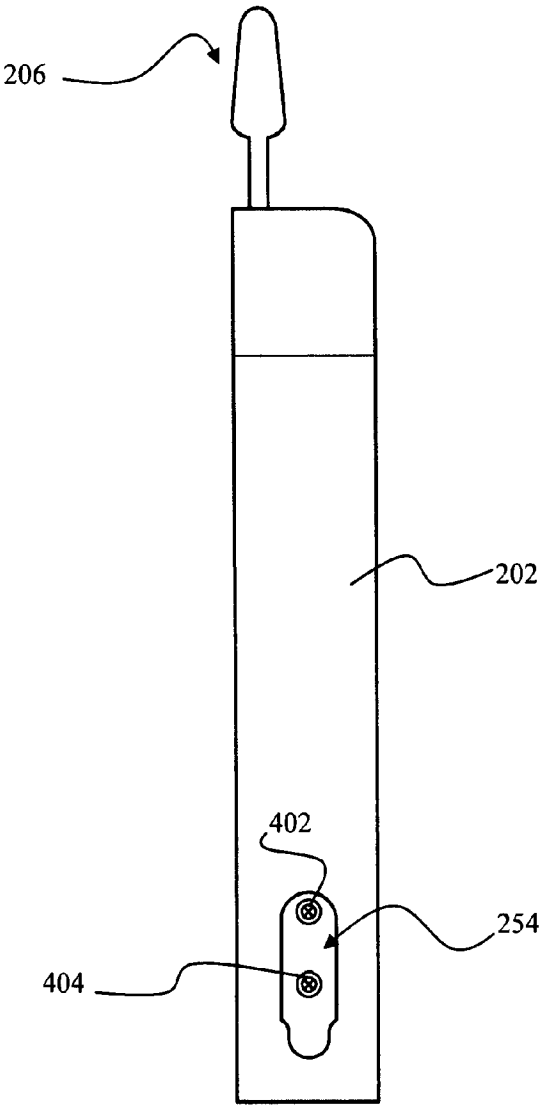
FIG. 4A is an exemplary side-view illustration of the portable folding bar of FIGS. 1A to 1C in accordance with the present invention.
Figure 4B:
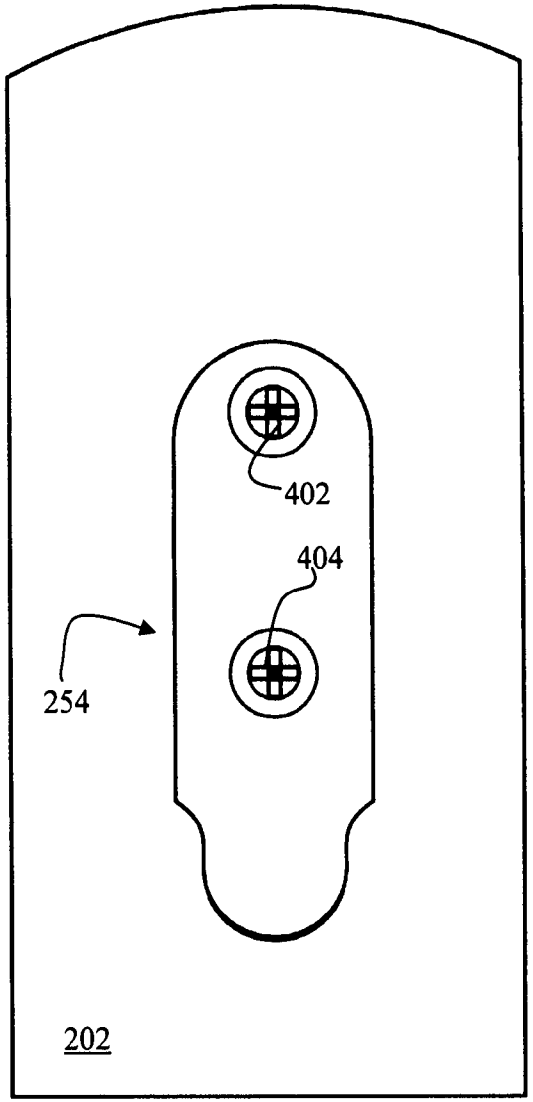
FIG. 4B is an exemplary plan-view illustration of a mounting cap for coupling a frame of the portable folding bar with its top piece in accordance with the present invention.
Figure 4C:
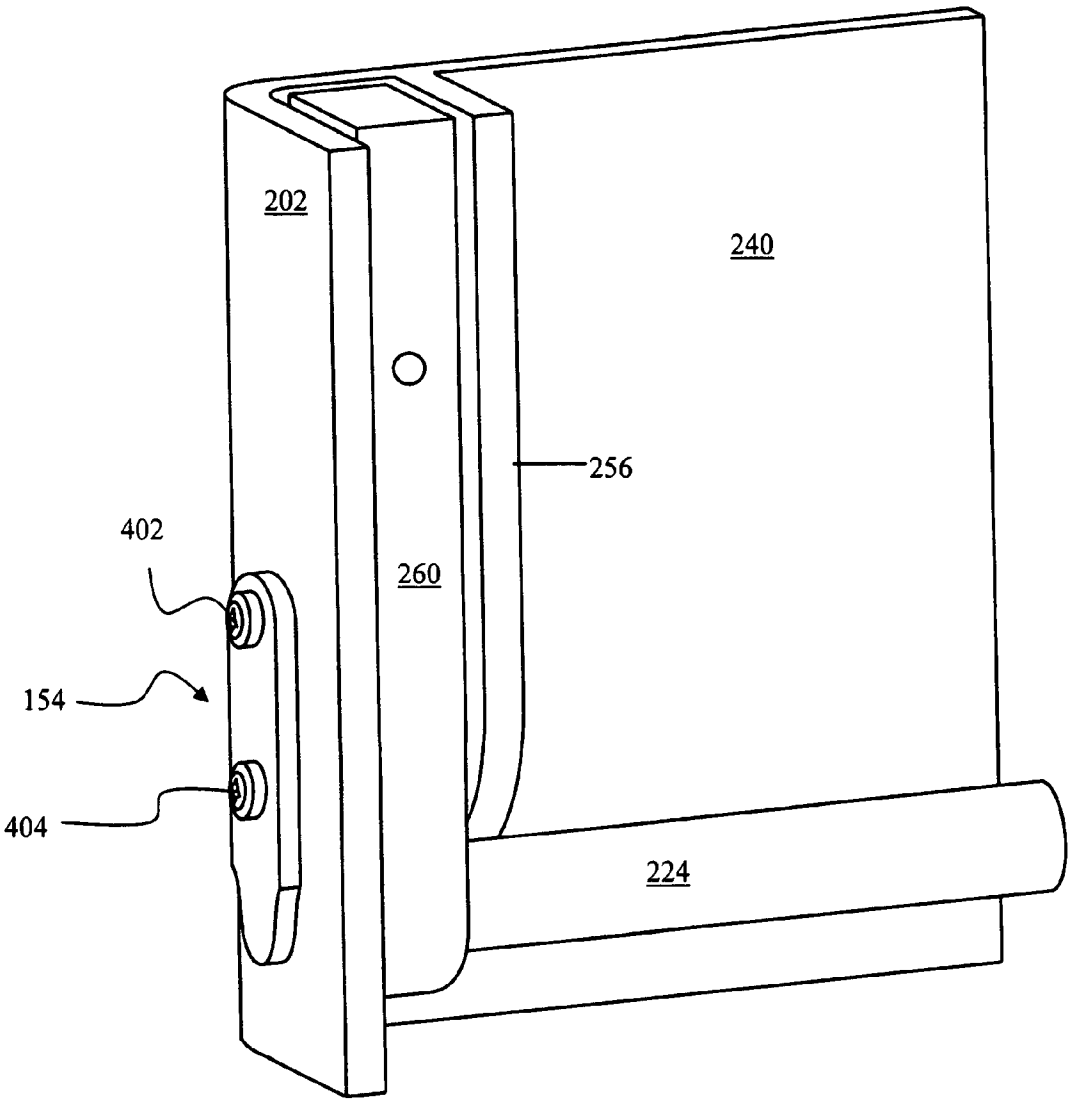
FIG. 4C is an exemplary perspective illustration of the mounting cap illustrated in FIG. 4B in accordance with the present invention.
Figure 4D:
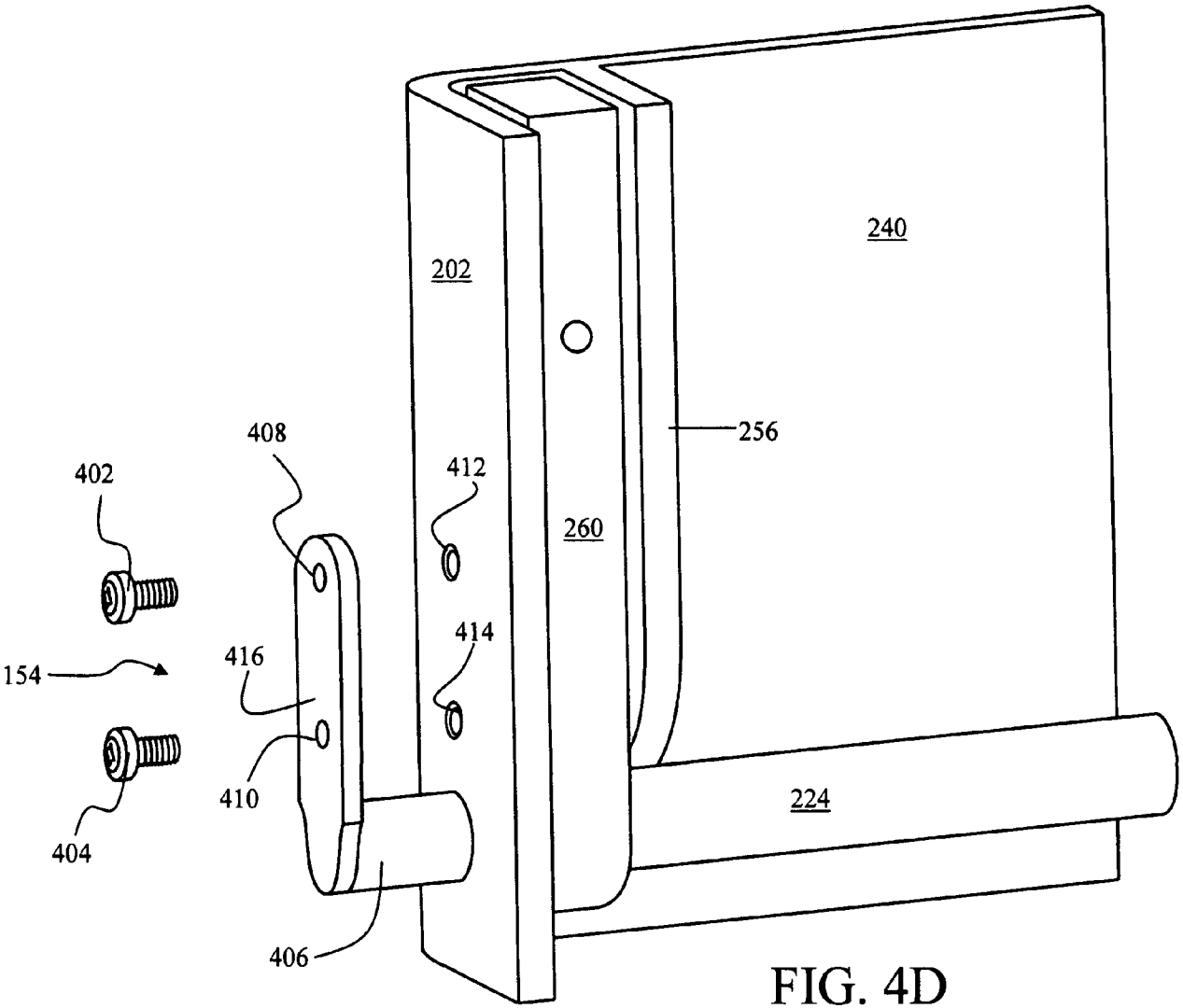
FIG. 4D is an exemplary perspective illustration of the mounting cap illustrated in FIG. 4B, showing details thereof in accordance with the present invention.

As illustrated in FIGS. 2A to 3, the table top piece 202 includes a substantially flat top surface that forms the table counter top. The table top piece 202 further includes an edge that spans around at least one side thereof with sufficient depth D for storage of the frame 204 when the frame 204 is folded in closed position. The depth D is commensurate with the thickness of the frame 204 so to allow sufficient space for the storage and housing of the frame 204 when in closed position, as illustrated in FIG. 2B. As further illustrated, the edge of the table top piece 202 further includes a notch 234 having a depth less than the depth D of the edge for storage of the handle 206 when the frame 204 is folded in closed position. Although the notch 234 is illustrated as substantially rectangular configuration with somewhat sharp edges (corners) it can comprise of any shape with rounded edges rather than edges at substantially 90 degrees.

As best illustrated in FIG. 3, the table top piece 202 also includes a first set of apertures 302 and 304 on lateral sides of the table top piece 202 and oriented along an axial width W thereof for coupling of the frame 204 to the aft section of table top piece 202 by a mounting cap 254 (mounting cap 154 is illustrated in FIGS. 1B and 1C, and is a mirror image of the mounting cap 254). The substantially flat bottom surface 240 of the table top piece 202 includes one or more frame guides 256, 226, 228, 230, and 258 juxtaposed in parallel and axially oriented perpendicular along an axial length L of the portable folding bar 100, and support the frame 204 to prevent lateral movement of the frame 204 when folded in closed position. Further included on the substantially flat bottom surface 240 of the table top piece 202 are a set of frame interlock mechanisms 250 and 252 to facilitate securing the frame 204 therein when the frame 204 is folded in close position.

As best illustrated in FIGS. 4A to 4D, the mounting cap 254 is a single piece, integral unit, that includes a first section 416 having a first and second mounting cap securing apertures 408 and 410 that are aligned with a respective second set of apertures 412 and 414 on lateral sides of the table top piece 202 and oriented along the axial width thereof. The mounting caps 254 further includes a third set of fasteners 402 and 404 that fasten the mounting cap 254 onto the lateral sides of the table top piece 202 via the first and second mounting cap securing apertures 408 and 410 and the aligned respective second set of apertures 412 and 414. As further illustrated, the mounting caps 254 and 154 further include a second section 406, perpendicular to the first section 416, that is comprised of a hollow tube with a first cross-sectional diameter that is inserted into a pivoting tube 224 that is hollow with a second cross-sectional diameter larger than the first cross-sectional diameter. This arrangement enables the frame 204 to pivot to one of a close and open positions while the second section 406 of the mounting caps 254 and 154 are secure within the hollow pivoting tube 224. Of course, second section 406 has to be of sufficient thickness to bear the weight of the frame 204. The hollow pivoting tube 224 rides on and rotates when the frame 204 is moved to one of a close and open positions. The second section 406 is placed through a first mounting cap aperture 304 on the table top piece 202 and the second mounting cap aperture 306 on the frame 204 and into the pivoting tube 224, thereby enabling the frame 204 to hang on the pivoting tube 224. When assembled, the first section 416 butts against the table top piece 202 with the screws coupling the two together. The second section placed through the table top piece 202, the frame 204, and couples with the pivoting tube 224. It should be noted that the mounting caps 154 and 254 are identical.

Referring back to FIGS. 1A to 3, the one or more frame guides 256, 226, 228, 230, and 258 are comprised of a first piece and a second piece that are juxtaposed at a distance and in parallel, and are axially oriented perpendicular along an axial length of the portable folding bar 100, and parallel along the axial width thereof. The first piece and the second piece of the one or more frame guides 256, 226, 228, 230, and 258 have an axial length that is shorter than the axial width of the portable folding bar 100. In general, the one or more frame guides 256, 226, 228, 230, and 258 have sufficient distance from one another to enable the frame struts 260, 218, 220, 222, and 242 of the frame 204 to be stored in between the first and the second pieces of the frame guides 256, 226, 228, 230, and 258, thereby preventing the frame struts to move laterally and bend.

Figure 5A:
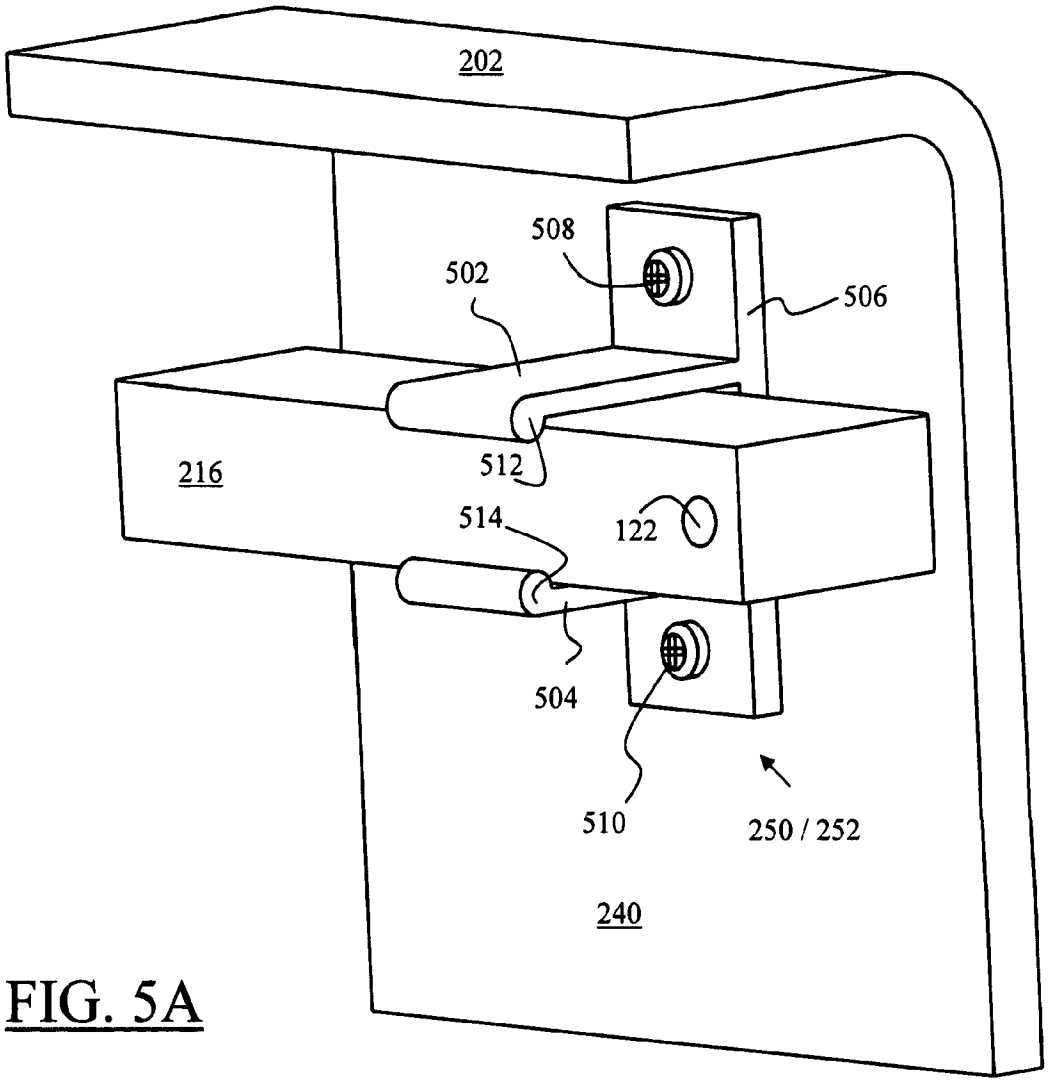
FIG. 5A is an exemplary assembled perspective illustration of a frame interlock mechanism of the portable folding bar of FIGS. 1A to 1C in accordance with the present invention.
Figure 5B:
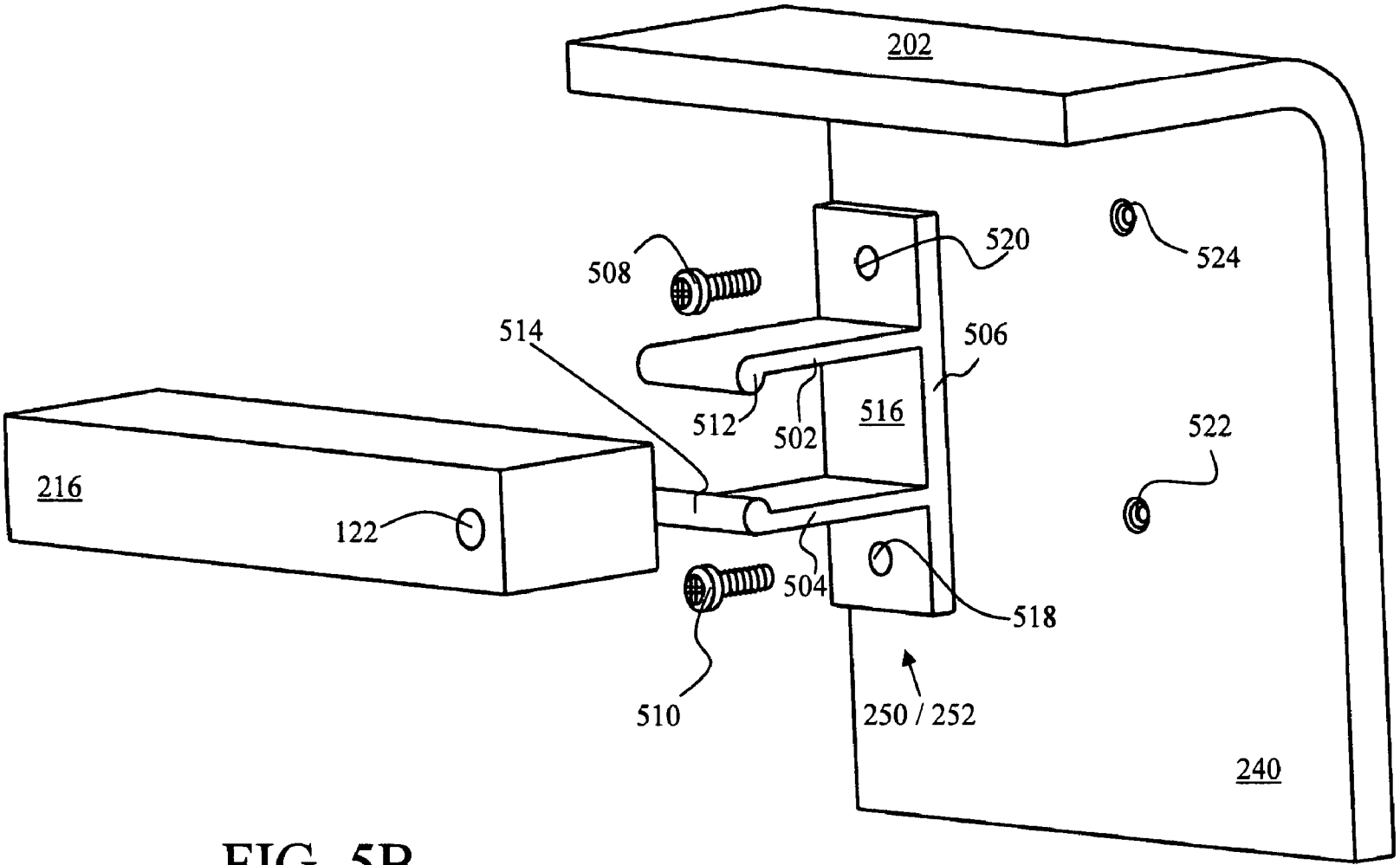
FIG. 5B is an exemplary disassembled perspective illustration of the frame interlock mechanism illustrated in FIG. 5A accordance with the present invention.
Figure 5C:
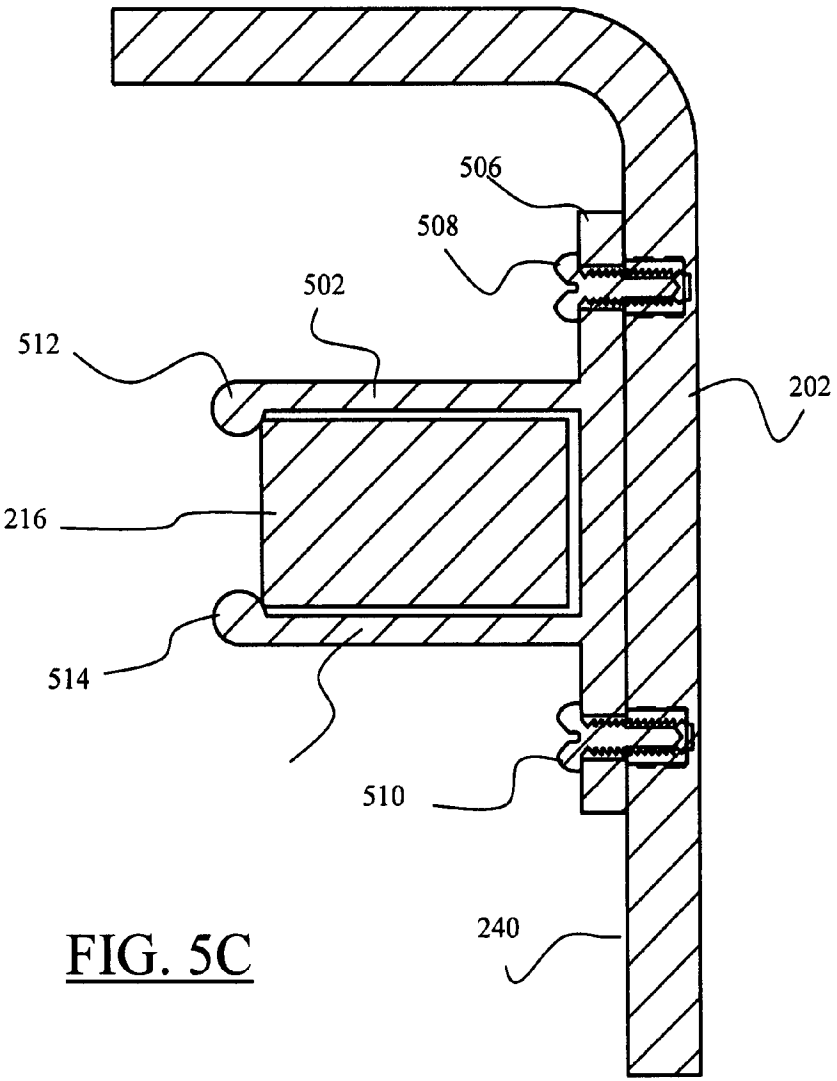
FIG. 5C is an exemplary assembled side cross-sectional view illustration of the frame interlock mechanism illustrated in FIG. 5A in accordance with the present invention.

As best illustrated in FIGS. 5A to 5C, the bottom surface 240 of the table top piece 202 further includes the frame interlock mechanisms 250 and 252, each of which is a single piece integral unit that is comprised of a first and second cantilevers 502 and 504. The first and second cantilevers 502 and 504 are coupled with a base 506 to form a substantially "U" shaped structure. Free ends of the first and second cantilevers 502 and 504 have rounded edges 512 and 514 facing an interior 516 of the frame interlock mechanisms 250 and 252 to facilitate insertion and removal of the frame 204 therein between the first and second cantilevers 502 and 504, and secure the frame 204 therein when the frame is folded in close position. The frame interlock mechanism 250 and 252 has a set of frame interlock apertures 518 and 520 aligned with a set of apertures 522 and 524 on the bottom surface 240 of the table top piece 202 to allow fasteners 508 and 510 to couple the frame interlock mechanism 250 and 252 with the bottom surface 240 of the table top piece 202.

As further illustrated in FIGS. 1A to 3, the frame 204 of the portable folding bar 100 is comprised of the first elongated member 216 and a second elongated member 224 that are spaced apart and juxtapose laterally, forming an axial length of the frame 204. One or more third members 260, 218, 220, 222, and 242 are substantially transversally oriented at an angle θ along the axial length of the frame 204. The one or more third members 260, 218, 220, 222, and 242 couple the first elongated member 216 with the second elongated member 224 (the pivoting tube) to form the frame 204. As illustrated, the one or more third members 260, 218, 220, 222, and 242 are comprised of a plurality of single piece units that are transversally oriented along the axial length of the frame 204. Each single piece having a first extremity and a second extremity, with the first extremity 130 coupled to the first elongated member 216 and the second extremity having an "O" shaped end jointed to the second elongated member 224, with each single piece oriented substantially perpendicular to the respective first and second elongated members 216 and 224. Accordingly, the second elongated member 224 in the form of the pivoting tube is inserted into the "O" configured second extremity of the one or more third members 260, 218, 220, 222, and 242. Further included on the first elongated member 216 of the frame 204 are a first set of mounting tabs 126 and 236 that may be optionally used to detachably couple the portable folding bar to structures. The second set of mounting tabs 124 and 234 are on the transversally oriented respective struts 218 and 222 of the frame 204.

Figure 6A:
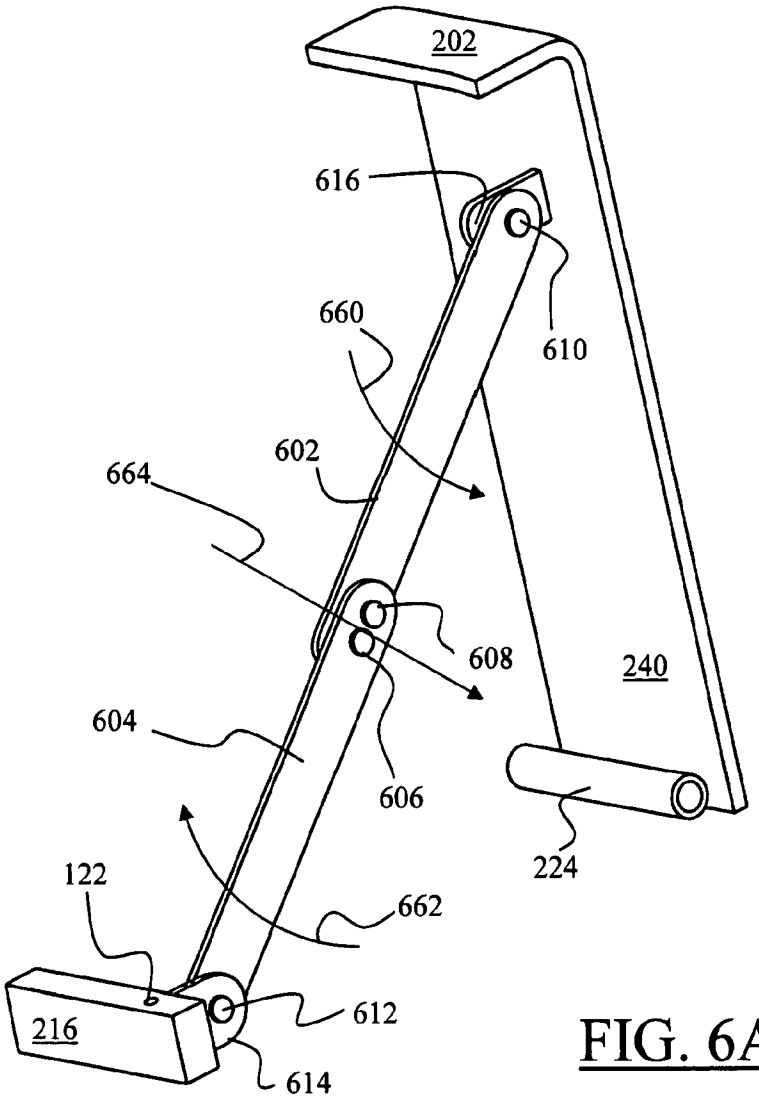
FIG. 6A is an exemplary assembled perspective view illustration of a collapsible support arm in a fully extended, open position of the portable folding bar of FIGS. 1A to 1C in accordance with the present invention.
Figure 6B:
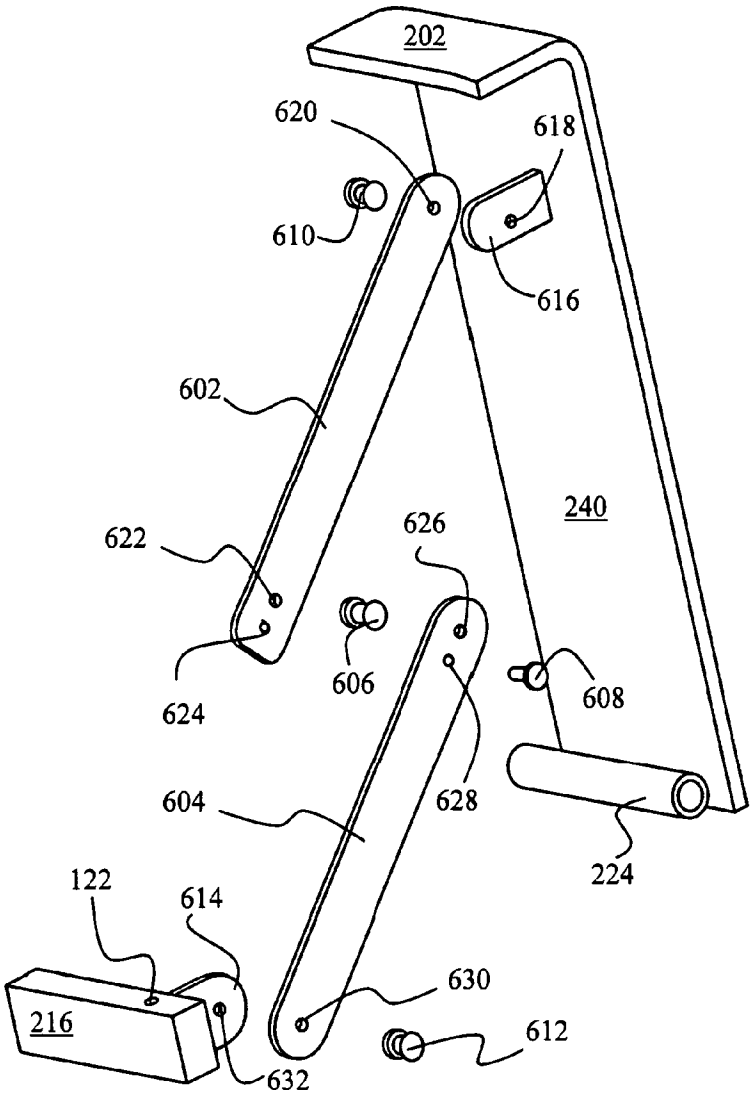
FIG. 6B is an exemplary disassembled perspective view illustration of the collapsible support arm in a fully extended, open position of the portable folding bar of FIGS. 1A to 1C in accordance with the present invention.
Figure 6C:
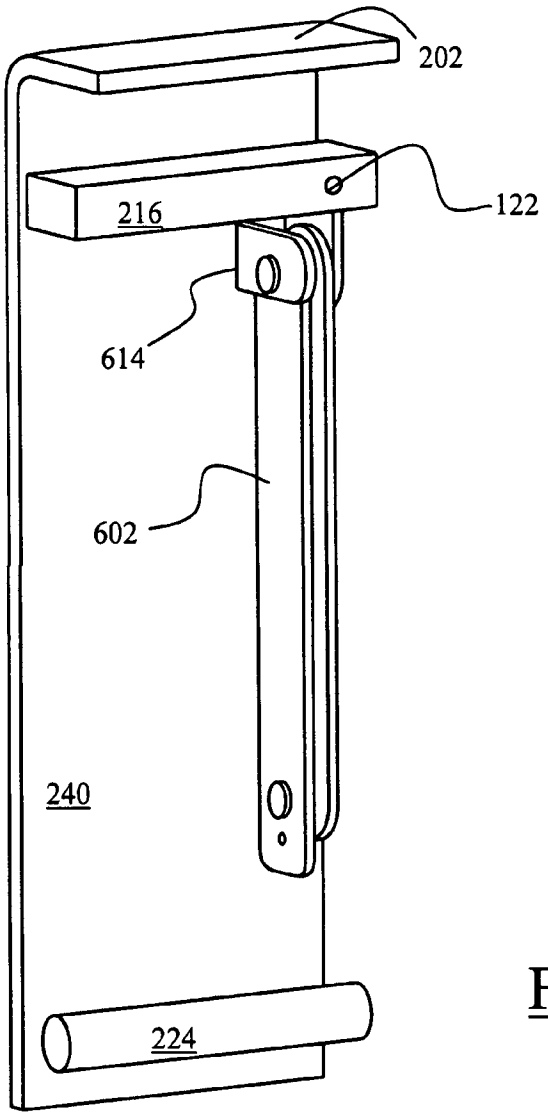
FIG. 6C is an exemplary assembled perspective view illustration of the collapsible support arm in a fully collapsed, closed position of the portable folding bar of FIGS. 1A to 1C in accordance with the present invention.
Figure 6D:
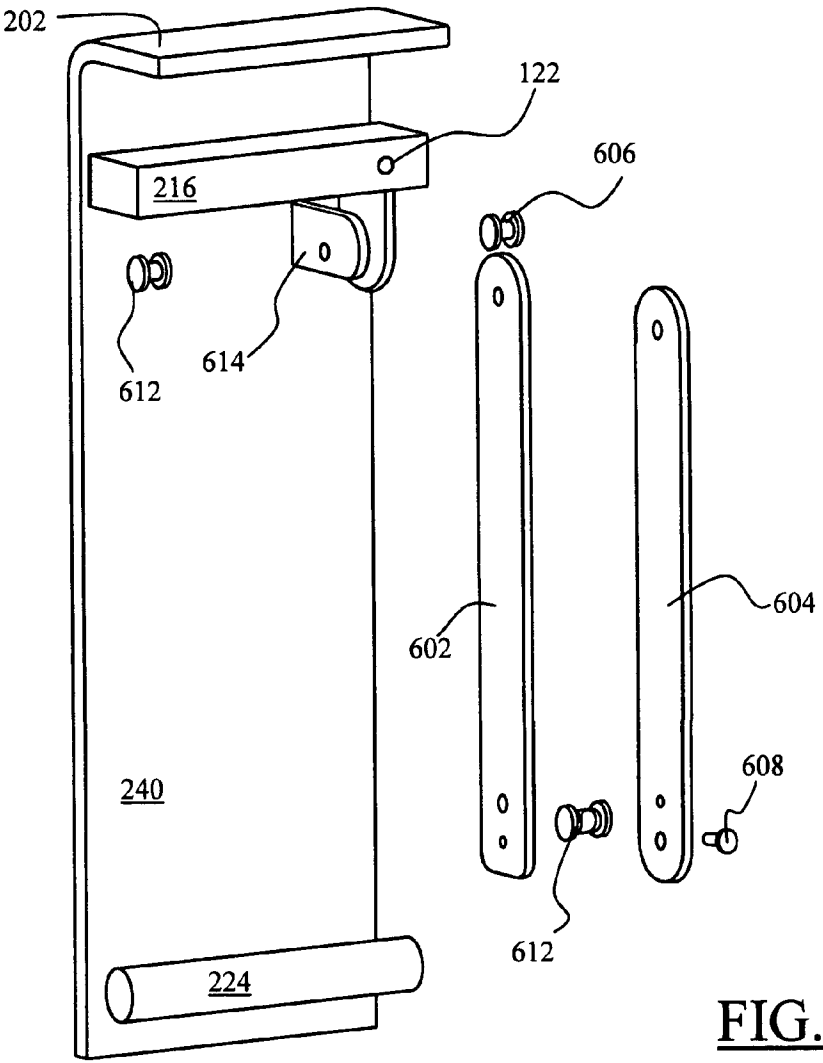
FIG. 6D is an exemplary disassembled perspective view illustration of the collapsible support arm in a fully collapsed, closed position of the portable folding bar of FIGS. 1A to 1C in accordance with the present invention.

As best illustrated in FIGS. 2A, 2B, 3, and 6A to 6D, the one or more collapsible support arms 208, 210, 212, and 214 of the frame 204 are comprised of a first arm section 602 and a second arm section 604. As best illustrated in FIG. 6A, when closing the portable folding bar 100, the first arm section 602 moves in the direction along the reciprocating path indicated by the reference numeral 660, with the second arm section 604 moving in the opposite direction along the reciprocating path indicated by the reference numeral 662. The center elbow section collapses along the reciprocating path indicated by the reference numeral 664 to completely position and house the frame 204 within the underside 240 of the table top piece 202.

The first arm section 602 has a first end and is coupled with the bottom surface 240 of the table top piece 202 by a first hinge mechanism. The first hinge mechanism is comprised of a first hinge tab 618 that is coupled with the bottom surface 240 of the table top piece 202, and includes an apertures 616 that couples via a first rivet 610 or the like through an aligned apertures 620 at the first end of the first arm section 602.

As further illustrated, the first arm section 602 further includes a first pivot end at a distal end that couples with the second pivot end of the second arm section 604 forming an elbow, and both of which arm sections are locked in an extended open position by a lock pin unit 608, 628, and 624 when the portable folding bar 100 is in the open position. This orients the table top piece 202 and the frame 204 perpendicular to one another, whereby the table top piece 202 is horizontal to ground and the frame 204 is vertical to ground. The first pivot end of the first arm section 602 includes a first aperture 622 coupled via a second rivet 606 or the like through an aligned aperture 626 at the second pivot end of the second arm section 604. The lock pin unit is comprised of a lock pin 608 or the like that is passed through aligned apertures 624 and 628 of the respective first and second pivot ends of the respective first and second arm sections 602 and 604.

As further illustrated, the second arm section 604 also includes a second end coupled with the first elongated member 216 of the frame 204 by a second hinge mechanism. The second hinge mechanism is comprised of a second hinge tab 614 that is coupled with the first elongated member 216 of the frame 204, and includes an apertures 632 that couples via a third rivet 612 or the like through an aligned apertures 630 at the second end of the second arm section 604.

Figure 7A:
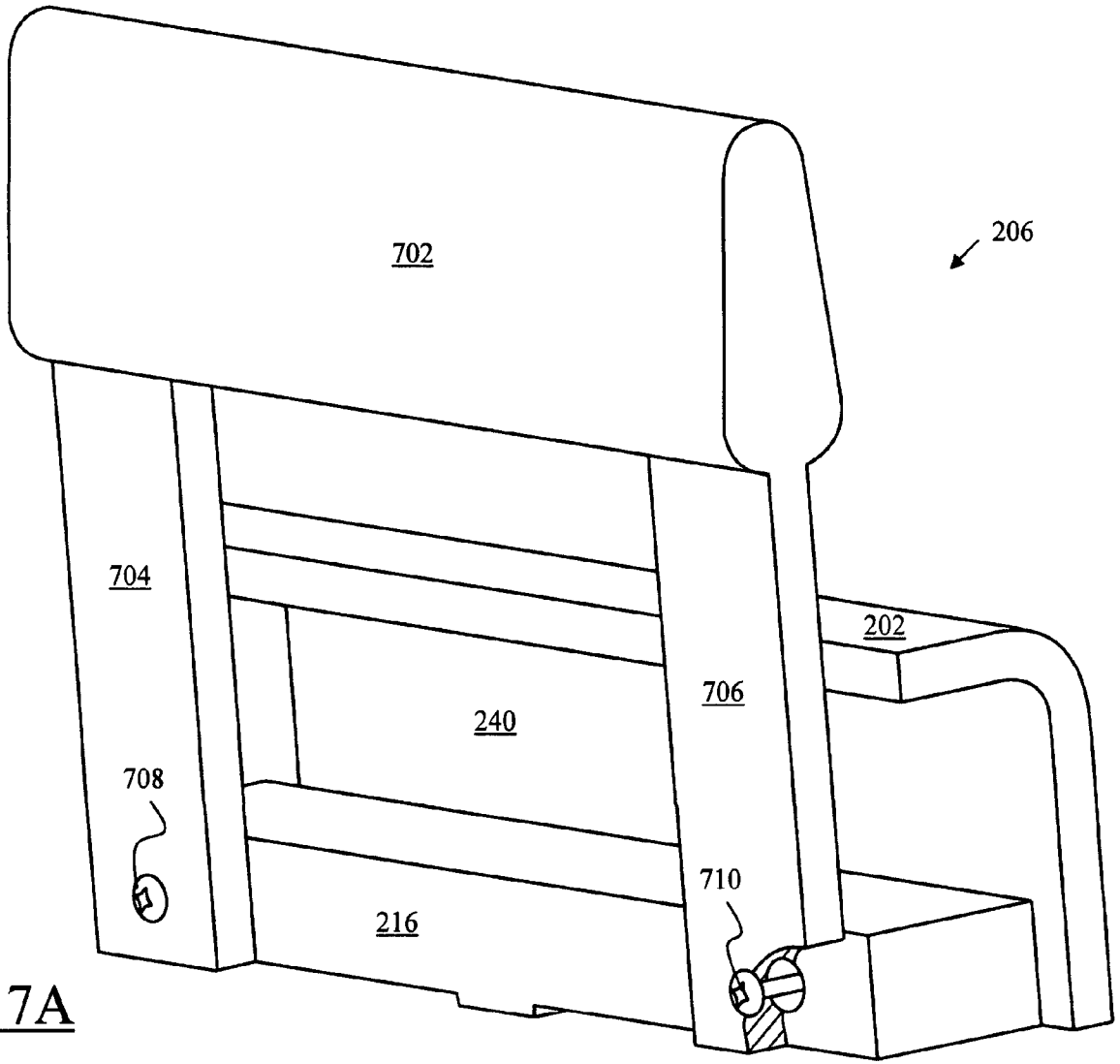
FIG. 7A is an exemplary assembled perspective illustration of an ergonomic handle of the portable folding bar of FIGS. 1A to 1C in accordance with the present invention.
Figure 7B:
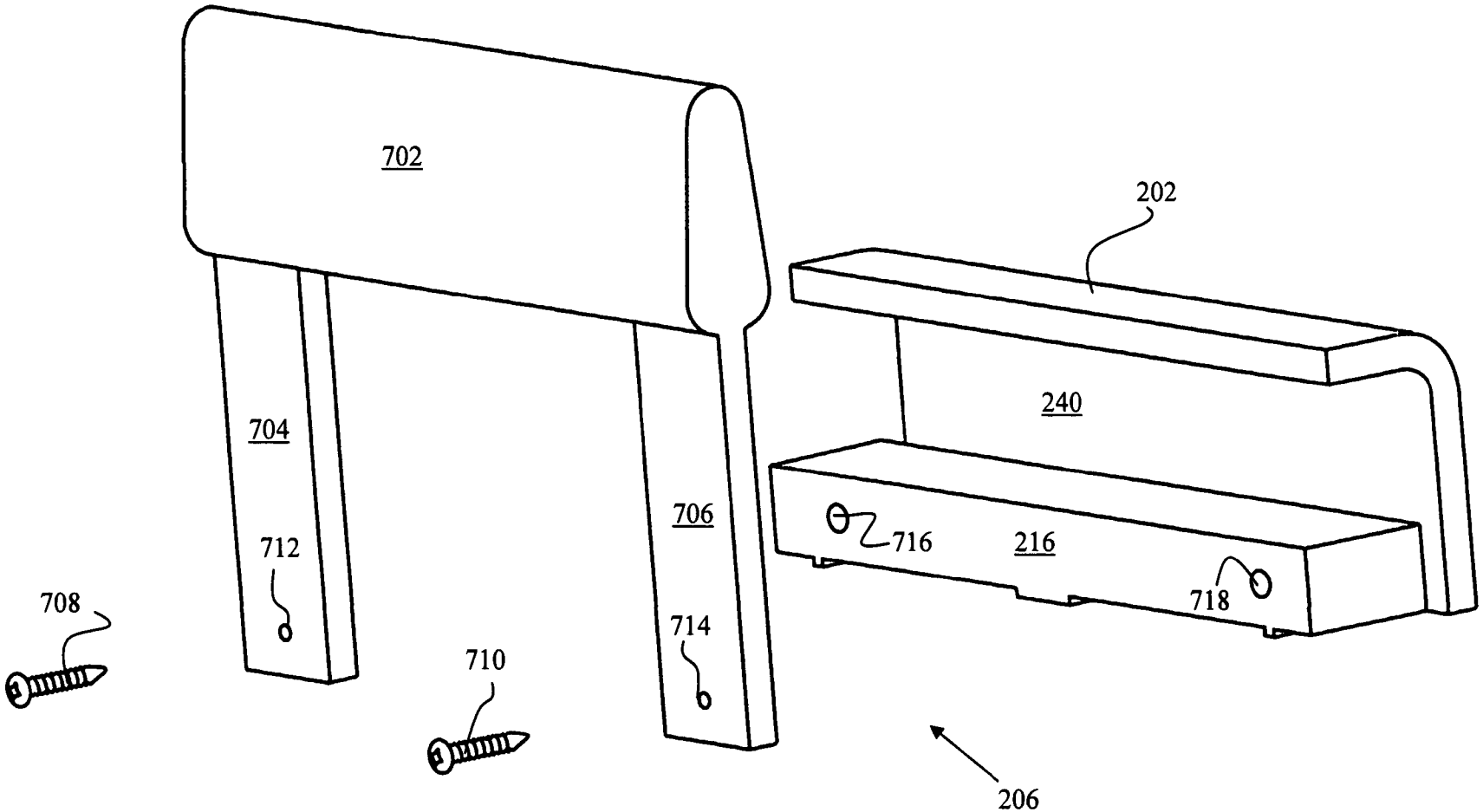
FIG. 7B is an exemplary disassembled perspective illustration of the ergonomic handle mechanism illustrated in FIG. 7A accordance with the present invention.
Figure 7C:
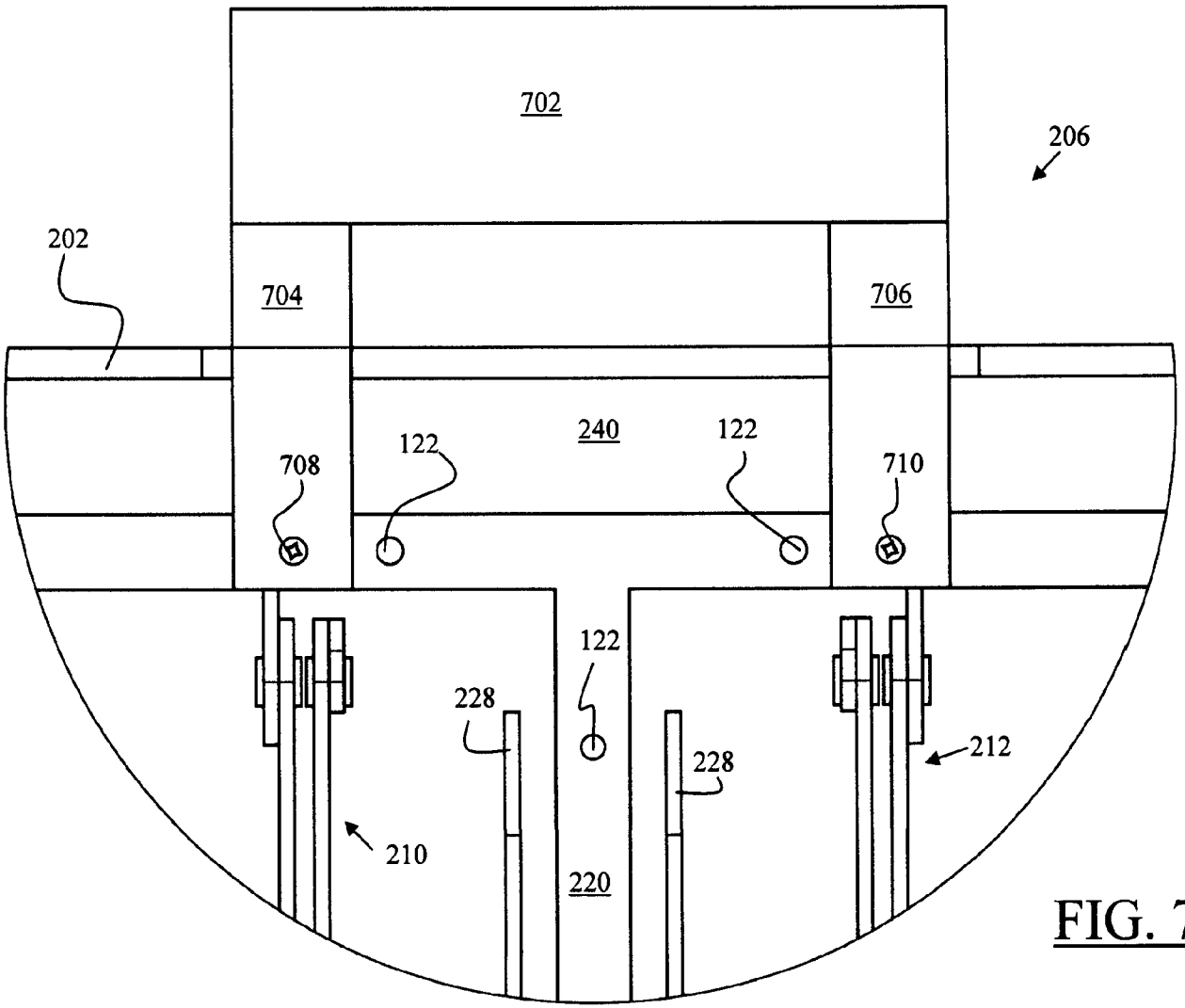
FIG. 7C is an exemplary assembled plan view illustration of the ergonomic handle illustrated in FIG. 7A in accordance with the present invention.

As best illustrated in FIGS. 7A to 7C, the portable folding bar 100 also includes a handle 206, which is comprised of an ergonomic handgrip 702 and two support posts 704 and 706. The ergonomic hand grip 702 is integral with the two support posts 704 and 706, which are, in turn, coupled with the first elongated member 216 of the frame 204. The frame 204 includes two apertures 716 and 718 that are aligned with two post apertures 712 and 714 and are couple by fasteners 708 and 710.

Although the invention has been described in considerable detail in language specific to structural features and or method acts, it is to be understood that the invention defined in the appended claims is not necessarily limited to the specific features or acts described. Rather, the specific features and acts are disclosed as preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. For example, the size, and the fasteners illustrated and described may be varied. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, proximal, distal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A portable folding bar, comprising:

a table top piece forming a table counter top;

a frame coupled with the table top piece for coupling with a structure;

a handle coupled with the frame for transporting the portable folding bar a bottom surface of the table top piece further includes:

frame interlock mechanism that is a single piece integral unit that is comprised of a first and second cantilevers that are coupled with a base to form a substantially "U" shaped structure, with a free ends of the first and second cantilevers having rounded edges facing an interior of the frame interlock mechanism to facilitate insertion and removal of the frame therein between the first and second cantilevers.

2. The portable folding bar as set forth in claim 1, wherein:

the table top piece includes:

a substantially flat top surface that forms the table counter top;

an edge around at least one side with sufficient depth for storage of the frame when the frame is folded in closed position;

the edge including a notch having a height less than the height of the edge for storage of the handle when the frame is folded in closed position;

a first set of apertures on lateral sides of the table top piece and oriented along an axial width of the table top piece for coupling of the frame to the table top piece by a mounting cap;

a substantially flat bottom surface that includes one or more frame guides juxtaposed in parallel and axially oriented perpendicular along an axial length of the portable folding bar, and the one or more frame guides support the frame to prevent lateral movement of the frame when folded in closed position.

3. The portable folding bar as set forth in claim 2, wherein:

the mounting cap is a single piece, integral unit, and includes:

a first section having a first and second mounting cap securing apertures that are aligned with a respective second set of apertures on lateral sides of the table top piece and oriented along the axial width thereof;

a set of fasteners that fasten the mounting cap onto the lateral sides of the table top piece via the first and second mounting cap securing apertures and the aligned respective second set of apertures;

a second section, perpendicular to the first section, that is comprised of a hollow tube with a first cross-sectional diameter that is inserted into a pivoting tube that is hollow with a second cross-sectional diameter larger than the first cross-sectional diameter, enabling the frame to pivot to one of a close and open positions while the second section of the mounting cap is secure within the hollow pivoting tube.

4. The portable folding bar as set forth in claim 2, wherein:

the one or more frame guides are comprised of:

a first piece and a second piece that are juxtaposed at a distance and in parallel, and are axially oriented perpendicular along an axial length of the portable folding bar, and parallel along the axial width thereof;

the first piece and the second piece of the one or more frame guides have an axial length that is shorter than the axial width of the table top piece; and the one or more frame guides have sufficient distance from one another to enable the frame struts to be stored in between the first and the second pieces of the one or more frame guides.

5. The portable folding bar as set forth in claim 1, wherein:

the frame is comprised of:

a first elongated member and a second elongated member that are spaced apart and juxtapose laterally, forming an axial length of the frame;

one or more a third members substantially transversally oriented at an angle θ along the axial length of the frame;

the one or more third members couple the first elongated member with the second elongated member to form the frame;

one or more collapsible support arms comprised of a first arm section and a second arm section;

the first arm section including a first end coupled with the bottom surface of the table top piece by a first hinge mechanism, and includes a first pivot end;

the second arm section including a second end coupled with the first elongated member of the frame by a second hinge mechanism, and includes a second pivot end;

the first pivot end is coupled with the second pivot end by a third hinge mechanism forming an elbow, and locked in an extended open position by a lock pin when the portable folding bar is in the open position, orienting the table top piece and the frame perpendicular to one another, whereby the table top piece is horizontal to ground and the frame is vertical to ground.

6. The portable folding bar as set forth in claim 1, wherein:

the frame further includes mounting holes that can be used to mount the frame onto the structure.

7. The portable folding bar as set forth in claim 1, wherein:

the handle includes:

an ergonomic hand grip;

two support posts;

the hand grip is integral with the two support posts;

the two support posts are coupled with a first elongated member of the frame; and the frame includes two apertures that is aligned with two post apertures and are couple by fasteners.

8. A portable folding bar, comprising:

a table top piece forming a table counter top;

a frame coupled with the table top piece for coupling with a structure;

a handle coupled with the frame for transporting the portable folding bar;

the table top piece includes:

a substantially flat top surface that forms the table counter top;

an edge around at least one side with sufficient depth for storage of the frame when the frame is folded in closed position;

the edge including a notch having a height less than the height of the edge for storage of the handle when the frame is folded in closed position;

a first set of apertures on lateral sides of the table top piece and oriented along an axial width of the table top piece for coupling of the frame to the table top piece by a mounting cap;

a substantially flat bottom surface that includes one or more frame guides juxtaposed in parallel and axially oriented perpendicular along an axial length of the portable folding bar, and the one or more frame guides support the frame to prevent lateral movement of the frame when folded in closed position;

the mounting cap is a single piece, integral unit, and includes:

a first section having a first and second mounting cap securing apertures that are aligned with a respective second set of apertures on lateral sides of the table top piece and oriented along the axial width thereof;

a set of fasteners that fasten the mounting cap onto the lateral sides of the table top piece via the first and second mounting cap securing apertures and the aligned respective second set of apertures;

a second section, perpendicular to the first section, that is comprised of a hollow tube with a first cross-sectional diameter that is inserted into a pivoting tube that is hollow with a second cross-sectional diameter larger than the first cross-sectional diameter, enabling the frame to pivot to one of a close and open positions while the second section of the mounting cap is secure within the hollow pivoting tube.

9. A portable folding bar, comprising:

a table top piece forming a table counter top;

a frame coupled with the table top piece for coupling with a structure;

a handle coupled with the frame for transporting the portable folding bar;

the table top piece includes:

a substantially flat top surface that forms the table counter top;

an edge around at least one side with sufficient depth for storage of the frame when the frame is folded in closed position;

the edge including a notch having a height less than the height of the edge for storage of the handle when the frame is folded in closed position;

a first set of apertures on lateral sides of the table top piece and oriented along an axial width of the table top piece for coupling of the frame to the table top piece by a mounting cap;

a substantially flat bottom surface that includes one or more frame guides juxtaposed in parallel and axially oriented perpendicular along an axial length of the portable folding bar, and the one or more frame guides support the frame to prevent lateral movement of the frame when folded in closed position;

the one or more frame guides are comprised of:

a first piece and a second piece that are juxtaposed at a distance and in parallel, and are axially oriented perpendicular along an axial length of the portable folding bar, and parallel along the axial width thereof;

the first piece and the second piece of the one or more frame guides have an axial length that is shorter than the axial width of the table top piece; and the one or more frame guides have sufficient distance from one another to enable the frame struts to be stored in between the first and the second pieces of the one or more frame guides.

10. A portable folding bar, comprising:

a table top piece forming a table counter top;

a frame coupled with the table top piece for coupling with a structure;

a handle coupled with the frame for transporting the portable folding bar;

the frame is comprised of:

a first elongated member and a second elongated member that are spaced apart and juxtapose laterally, forming an axial length of the frame;

one or more a third members substantially transversally oriented at an angle θ along the axial length of the frame;

the one or more third members couple the first elongated member with the second elongated member to form the frame;

one or more collapsible support arms comprised of a first arm section and a second arm section;

the first arm section including a first end coupled with the bottom surface of the table top piece by a first hinge mechanism, and includes a first pivot end;

the second arm section including a second end coupled with the first elongated member of the frame by a second hinge mechanism, and includes a second pivot end;

the first pivot end is coupled with the second pivot end by a third hinge mechanism forming an elbow, and locked in an extended open position by a lock pin when the portable folding bar is in the open position, orienting the table top piece and the frame perpendicular to one another, whereby the table top piece is horizontal to ground and the frame is vertical to ground.

* * * * *